US005132733A

United States Patent [19]

Koizumi et al.

[11] Patent Number: 5,132,733

[45] Date of Patent: Jul. 21, 1992

[54] IMAGE FORMING APPARATUS HAVING A PLURALITY OF DEVELOPING UNIT

[75] Inventors: Yutaka Koizumi; Kenichi Mizuma, both of Yokohama, Japan

[73] Assignee: Ricoh Company, Ltd., Tokyo, Japan

[21] Appl. No.: 613,934

[22] Filed: Nov. 13, 1990

Related U.S. Application Data

[63] Continuation of Ser. No. 404,207, Sep. 7, 1989, abandoned.

[30] Foreign Application Priority Data

Sep. 8, 1988 [JP] Japan ..... 63-223500

[51] Int. Cl.[5] ..... G03G 15/06

[52] U.S. Cl. ..... 355/245; 355/327; 118/645

[58] Field of Search ..... 355/326, 327, 245, 251, 355/253; 118/645, 657, 658

[56] References Cited

U.S. PATENT DOCUMENTS 4,593,991 6/1986 Aoki et al. ..... 355/327
4,705,394 11/1987 Watanabe ..... 355/245
4,728,987 3/1988 Diola et al. ..... 355/245
4,743,938 5/1988 Ohno ..... 355/327
4,746,951 5/1988 Hayakawa et al. ..... 355/245
4,801,972 1/1989 Kusumoto et al. ..... 355/326 X
4,891,674 1/1990 Seyfried ..... 355/326 X

*Primary Examiner*—R. L. Moses
*Attorney, Agent, or Firm*—Oblon, Spivak, McClelland, Maier & Neustadt

[57] ABSTRACT

An image forming apparatus having an image carrier for forming an electrostatic latent image thereon, and a plurality of developing units each facing the image carrier and movable toward and away from the image carrier. A developing roller driving mechanism serves two different functions at the same time, i.e., causing any of the developing units to move between a developing and a non-developing position and driving the developing roller associated with the developing unit. When the developing roller driving mechanism is operated, the developing unit is moved to the developing position in the event of development and to the non-developing position in the event of non-development.

3 Claims, 4 Drawing Sheets

IMAGE FORMING APPARATUS HAVING A PLURALITY OF DEVELOPING UNIT

This application is a continuation of application Ser. No. 07/404,207, filed on Sep. 7, 1989, now abandoned.

BACKGROUND OF THE INVENTION

1. Field of the Invention

The present invention relates to an image forming apparatus having an image carrier for forming an electrostatic latent image thereon, and a plurality of developing units facing the image carrier and individually movable toward and away from the image carrier. More particularly, the present invention is concerned with an image forming apparatus which allows each developing unit to be shifted between a developing and a non-developing position surely and easily.

2. Discussion of the Background

An image forming apparatus of the type having a plurality of developing units located to face a photoconductive element or similar image carrier is extensively used today. A color electrophotographic copier, printer or facsimile machine, for example, develops a latent image by moving a desired developing unit toward a developing position defined on an image carrier while moving the other developing units or only developing rollers thereof away from the developing position. With this implementation, it is possible to prevent a toner image produced by one developing unit from being disturbed by the other developing units. For example, assume there is a toner image developed by a developing unit which is located upstream of the others with respect to an intended direction of rotation of the image carrier. Then, without such an implementation, the toner image would be disturbed by toners being deposited on the developing rollers of the other developing units. The above implementation also serves to prevent toners of different colors stored in the individual developing units from being mixed together.

Various approaches for moving a developing unit itself toward and away from an image carrier have been proposed, as disclosed in Japanese Patent Publication No. 55-3707 and Japanese Laid-Open Patent Publication No. 52-18332, for example. An approach for moving a developing roller alone is taught in Japanese Laid-Open Patent Publication No. 52-18332. However, the prior art schemes which move the whole developing unit need springs or similar biasing members for yieldably maintaining the individual developing units in a predetermined position, and an exclusive driver for moving the individual developing units toward and away from the developing position, resulting in a complicated construction. The prior art schemes of the kind for moving a developing roller only as stated above have a drawback in that it is difficult to transmit a driving force to the developing roller because the developing roller itself is movable within the developing unit.

SUMMARY OF THE INVENTION

It is therefore an object of the present invention to provide an image forming apparatus which, with a simple construction, insures easy and sure movement of individual developing units between a developing and a nondeveloping position.

It is another object of the present invention to provide a generally improved image forming apparatus.

An image forming apparatus of the present invention comprises an image carrier for forming an electrostatic latent image thereon, a plurality of developing units each being located to face the image carrier, a developing roller incorporated in each of the plurality of developing units for developing the latent image, a support for supporting the developing units such that the developing units are individually movable between a developing position for effecting development and a nondeveloping position for not effecting development, and a developing roller driving mechanism for causing each of the developing units to move between the developing and nondeveloping positions and driving the developing roller associated with the developing unit in a rotary motion.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
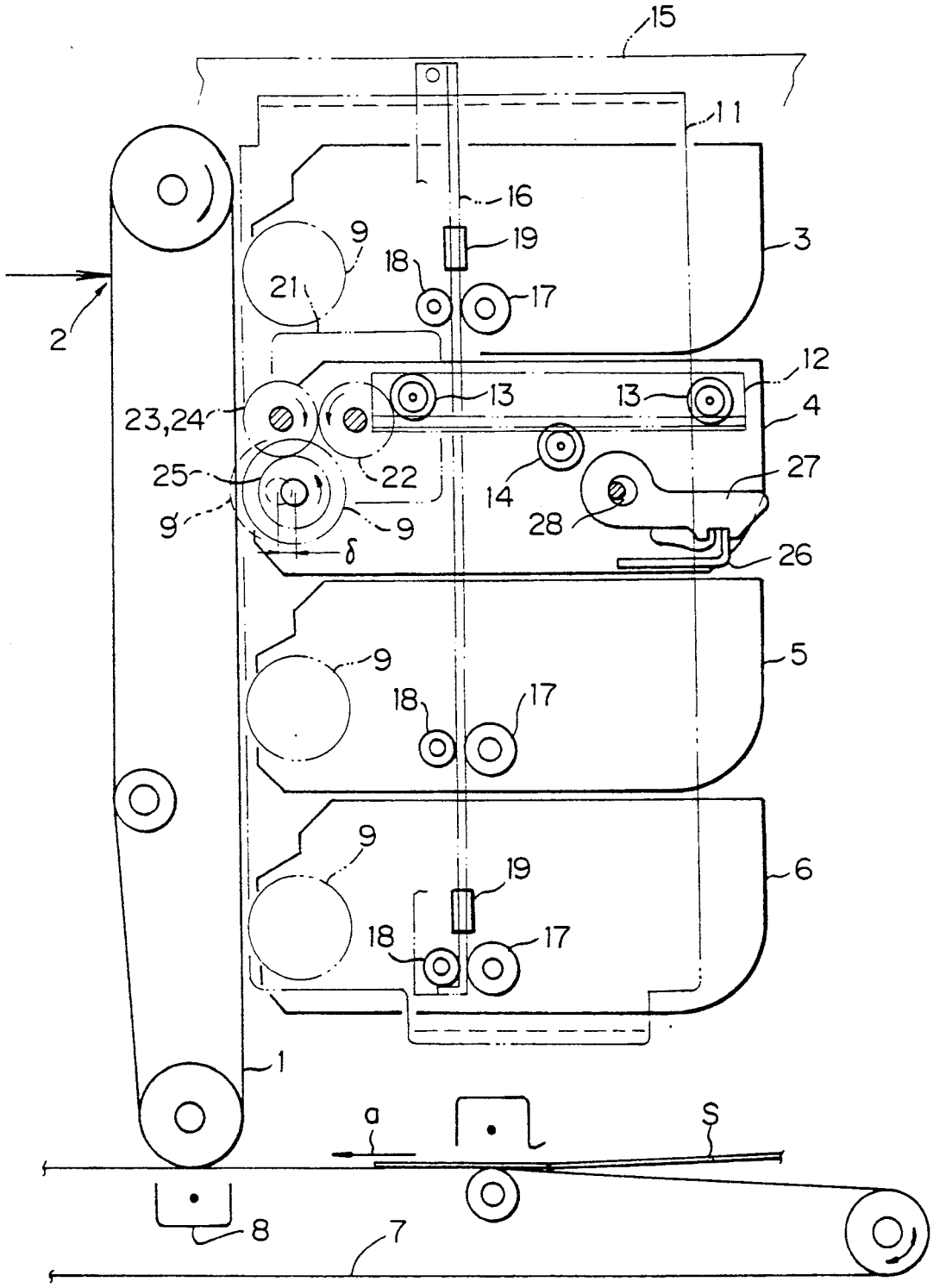
FIG. 1 is a schematic front view of an image forming apparatus embodying the present invention.

Referring to FIG. 1 of the drawings, an image forming apparatus embodying the present invention is shown and includes a photoconductive element in the form of a belt 1. At an exposing position 2, a latent image is electrostatically formed on the belt 1 by optical writing or the projection of an optical image. A plurality of developing units, four units, 3, 4, 5 and 6 in the illustrative embodiment, are located to face the belt 1. Each of the developing units 3 to 6 stores a developer or toner of a different color so as to develop a latent image to thereby produce a toner image. A belt 7 for image transfer is located below and perpendicular to the belt 1. When a paper sheet S is fed onto the belt 7, the belt 7 is rotated in both directions to transport the paper sheet S back and forth. While the belt 7 is moved in a direction indicated by an arrow a, for example, a transfer charger 8 is energized to transfer a toner image from the belt 1 to the paper sheet S. More specifically, toner images of different colors are sequentially transferred one upon another to the paper sheet S, resulting in a predetermined color image being formed on the paper sheet S.

Having exactly the same construction, the developing units 3 to 6 each includes a developing roller 9 for developing the electrostatic latent image. The developing units 3 to 6 are accommodated in a frame 11, and each is movable relative to the latter between an operative and an inoperative position.

Figure 2:
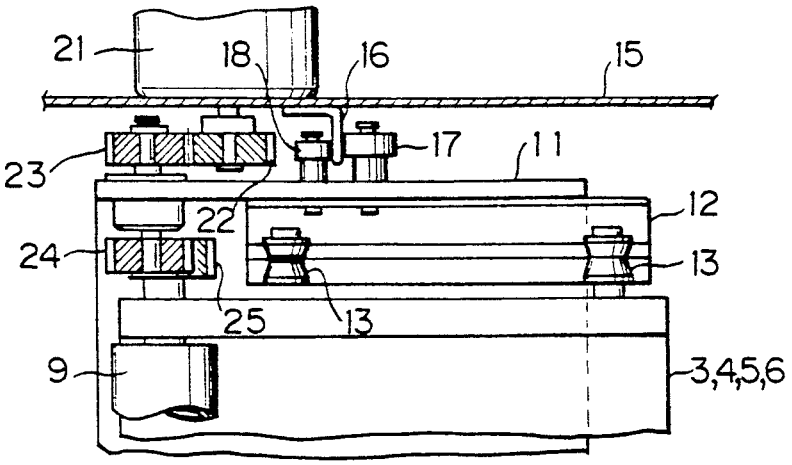
FIG. 2 is a fragmentary plan view of the embodiment.
Figure 3:
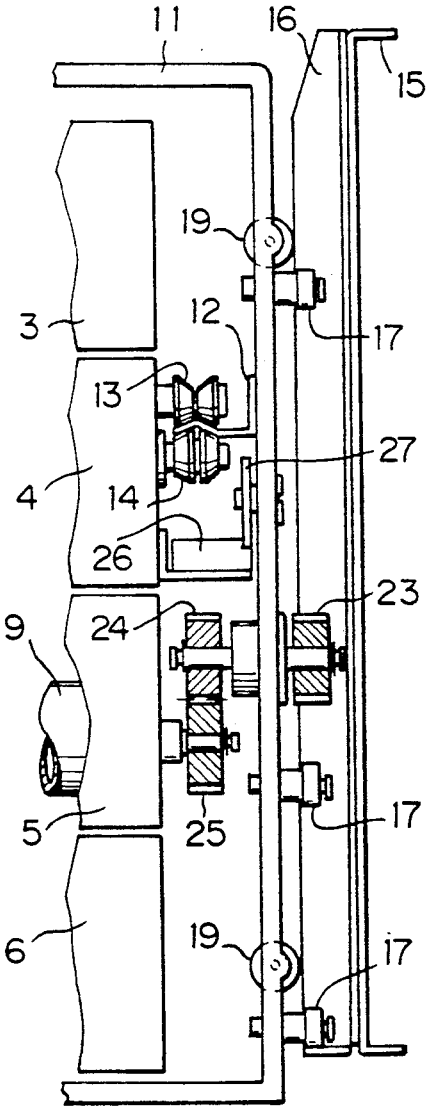
FIG. 3 is a fragmentary side elevation of the embodiment.

As shown in FIGS. 1, 2 and 3, a guide rail 12 is rigidly mounted on the frame 11, while guide rollers 13 and 14 are mounted on each of the developing units 3 to 6. The guide rollers 13 and 14 hold the guide rail 12 therebetween. As the guide rollers 13 and 14 roll on the guide rail 12, their associated developing unit is moved between the above-mentioned two positions. It is to be noted that not only the guide rollers 13 and 14 but also other various components which will be described are provided on all of the developing units 3 to 6 in exactly the same configuration. The developing units 3 to 6 are individually removable from the frame 11 in a direction perpendicular to the belt 1, i.e. sideways. Although not shown in the figures, another guide rail is mounted on the other side of the frame 11 while similar guide rails 13 and 14 are mounted on the other side of each developing unit to roll on the guide rail.

The operative position mentioned previously is a position where a latent image can be developed by a developer and will hereinafter be referred to as a developing position. In the illustrative embodiment, the developing position allows the developing roller 9 to contact the belt 1 while slightly biting into the latter, as indicated by the reference numeral 9'. The operative position, or nondeveloping position as distinguished from the developing position, is spaced apart from the belt 1; the developer deposited on the developing roller 9 does not make contact with the belt 1 there.

A guide rail 16 is mounted on each of opposite side walls (only one side wall 15 is shown) of a body of the apparatus. Guide rollers 17, 18 and 19 are mounted on those walls of the frame 11 which individually face the opposite side walls of the guide rail 16. The guide rollers 17, 18 and 19 are rollable on the guide rail 16 to allow the frame 11 to be bodily moved in the up-and-down direction relative to the apparatus body. The frame 11 is thus movable into and out of the apparatus body together with the developing units 3 to 6. A motor 21 is mounted on the side wall 15 of the apparatus body. The rotation of the motor 21 is transmitted to the developing roller 9 by a motor gear 22, gears 23 and 24 mounted on the frame 11, and a developing roller gear 25 mounted on the developing unit (see FIG. 4). In this particular embodiment, one motor 21 is associated with each of the developing units 3 to 6. Alternatively, a single motor 21 may be drivably connected to the developing rollers 9 of all of the developing units through clutches so as to rotate the developing rollers 9 or to move the developing units as will be described.

The developing unit 4 is now selected for development. Then, when the motor 21 is rotated counterclockwise as indicated by an arrow in FIG. 1, it rotates the integral gears 23 and 24 through the motor gear 22 clockwise as also indicated by an arrow in FIG. 1. The gear 24 tends to rotate the developing roller 9 through the developing roller gear 25 which is integral with the developing roller 9. However, while development is not performed, the developing roller 9 of the developing unit 4 is held in its nondeveloping position, or home position, spaced apart from the belt 1. In this condition, the load acting against the rotation of the developing roller 9 is far heavier than the load acting against the movement of the developing unit 4 itself, due to the influence of the other driven members such as a rotatable agitator (not shown) which is installed in the unit 4. Hence, in the beginning, the above-mentioned gear 24 exerts a force on the developing unit 4 in such a manner as to cause the unit 4 to move linearly. As a result, the developing unit 4 is bodily moved by a distance δ until an angle bar 26 mounted on the unit 4 abuts against the left end of a notch 27*a* which is formed in the frame 11.

Then, a rotating force acts on the developing roller 9. The roller 9 is, therefore, caused to rotate in contact with the belt 1 at the position 9' so as to develop an electrostatic latent image formed on the belt 1. After the roller 9 has developed a predetermined area, the motor 21 is rotated clockwise to return the developing unit 4 to the nondeveloping position or home position.

Whether the developing unit 4 may be moved toward the developing position or toward the nondeveloping position, the gears 25 and 24 are held in constant mesh with each other. Nevertheless, the distance between the axes of the gears 25 and 24 is little changed and, therefore, does not effect the transmission of power, because the distance δ which the developing unit 4 travels is short. For example, assuming that the gears 25 and 24 have twenty teeth each, the module is 1, and the distance δ is 3.5 millimeters, the change in the distance between the axes of the gears 25 and 24 is 0.3 millimeter which is negligible in practice. Thus, not only the developing unit 4 is shifted smoothly between the developing and non-developing positions, but also the developing roller 9 is driven with accuracy.

As stated above, the mechanism for driving the developing roller 9 serves two different functions at the same time, i.e., simultaneously shifting the developing unit between the two positions and driving the developing roller 9 in a rotary motion. This eliminates the need for an exclusive driver otherwise needed for shifting the developing unit, as well as the need for a spring or similar biasing means heretofore used to space apart the developing unit from the belt 1. The construction is, therefore, simpler than the prior art.

Assuming that the belt 1 is rotated at a rate of 120 millimeters per second or so, the peripheral speed of the developing roller 9 should generally be 300 millimeters per second or so although it depends on other various conditions. Then, when the motor 21 begins to rotate, only a little less than 0.02 seconds is needed for the developing unit to move the distance δ of 3.5 millimeters. This causes a substantial instantaneous change in load to act on the belt 1 and thereby tends to vary the rotational speed of the belt 1. In the worst case, such a variation in the rotation speed of the belt 1 would bring individual developed images out of register with each other. To eliminate such an occurrence, it is necessary that the above-mentioned moving time of the developing unit be increased by at least ten times. In the light of this, the motor 21 may be implemented as a motor whose rotational speed is variable. Specifically, a variable speed motor may be rotated at a low speed while the developing unit is shifted toward the developing position, at a high speed while development is under way, and at a low speed and in the opposite direction while the developing unit is returned toward the nondeveloping position. This will cause the load to act on the belt 1 little by little to thereby eliminate the deviation of associated images from each other.

In FIG. 1, the stop 27 is associated with each of the developing units 3 to 6 for positioning the associated developing unit and, at the same time, locking the unit to the frame 11. Any of the developing units may be removed sideways simply by releasing the associated stop 27. This is successful in promoting easy assembly and maintenance of this kind of developing unit. In addition, the developing units having exactly the same configuration enhance the a reduction of cost.

As shown in FIG. 1, the stop 27 is supported by an eccentric pin 28. By rotating the eccentric pin 28, it is possible to adjust the position of the stop 27 in the right-and-left direction as viewed in FIG. 1 and thereby the degree of abutment of the developing roller 9 against the belt 1.

The frame 11 is bodily removable from the apparatus body, as previously stated. This will provides a wide open space at the right-hand side of the belt 1 as viewed in FIG. 1, promoting ease of maintenance, inspection, etc. That is, it is not necessary for one to remove the developing units 3 to 6 one by one from the frame 11.

Figure 4:
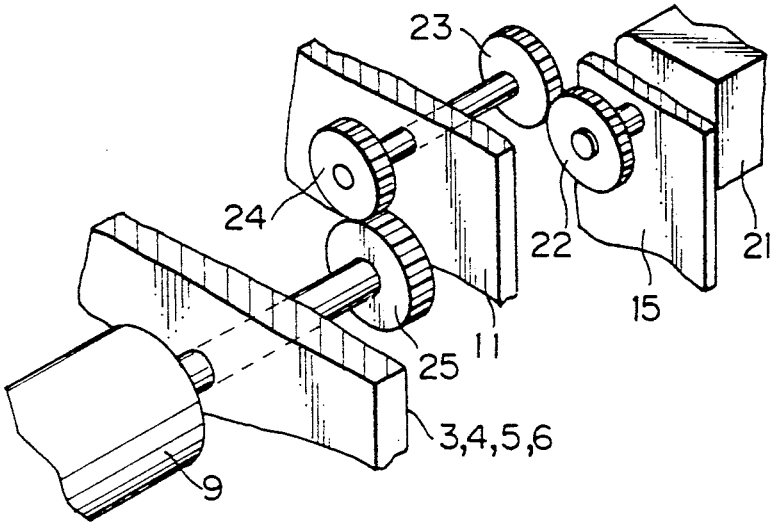
FIG. 4 is a perspective view of a developing roller driving mechanism included in the embodiment.

As shown in FIG. 4, when the frame 11 is pulled upward away from the apparatus body together with the developing unit 3 (4, 5, 6), the gear 23 will be released from the motor gear 22. When the developing unit 3 is removed from the frame 11 having been dismounted from the apparatus body, the gear 25 of the developing unit 3 will be released from the gear 24 of the frame 11.

Figure 5:
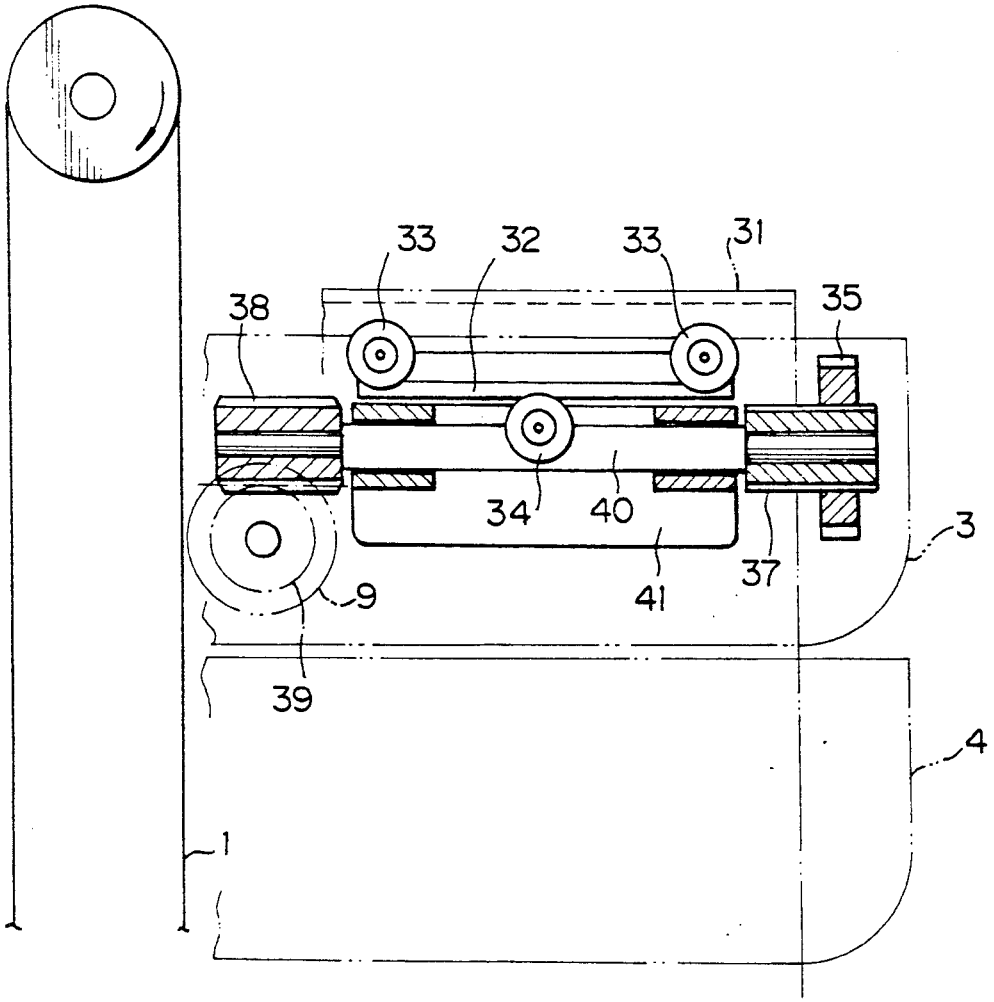
FIG. 5 is a partly broken front view of an alternative embodiment of the present invention.
Figure 6:
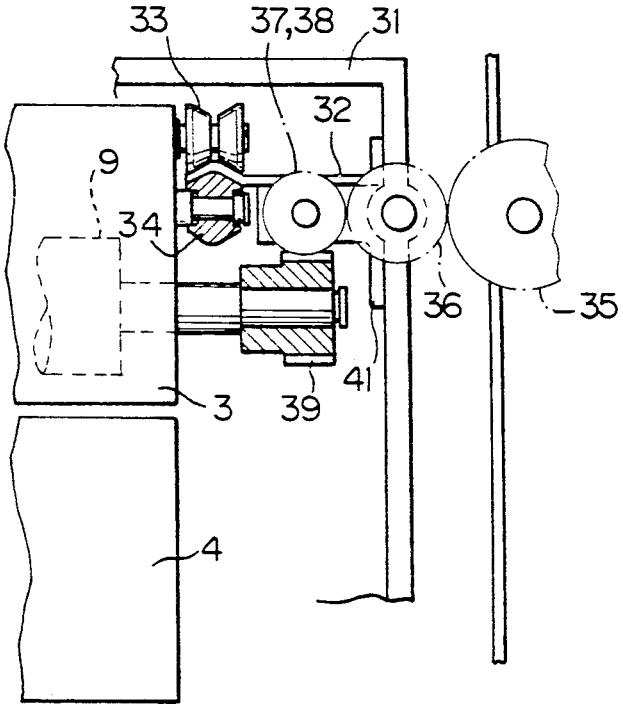
FIG. 6 is a fragmentary side elevation of the embodiment shown in FIG. 5.
Figure 7:
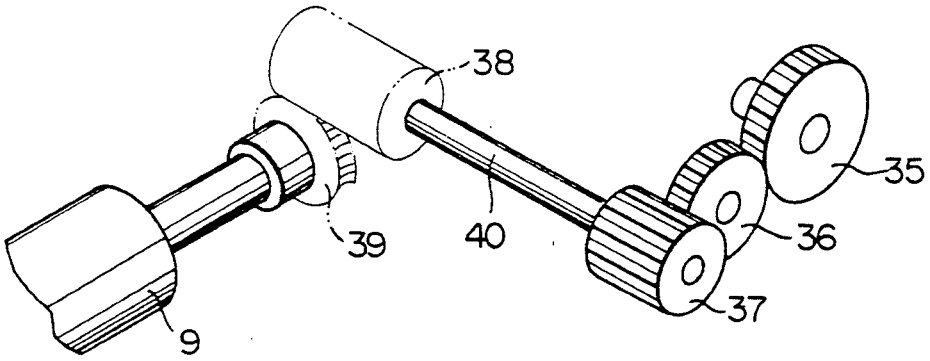
FIG. 7 is a perspective view of a developing roller driving mechanism included in the embodiment of FIG. 5.

Referring to FIG. 5, an alternative embodiment of the present invention is shown. As shown, the alternative embodiment has a frame 31 on which a guide rail 32 is mounted. Guide rollers 33 and 34 are mounted on each developing unit to roll on the guide rail 32. The developing unit is, therefore, freely movable away from the belt 1, as in the previous embodiment (see FIG. 6). A characteristic feature of the alternative embodiment is that the gearing using spur gears (including helical gear and crossed helical gears) of the previous embodiment is replaced with a gearing which uses a worm gear. Specifically, as shown in FIGS. 6 and 7, a motor gear 35 is driven by a motor, not shown. The rotation of the motor gear 35 is transmitted to the developing roller 9 via an idle gear 36, gear 37, a worm 38 integral with the gear 37, and a worm gear 39 which are mounted on the frame 31. The gear 37 and worm 38 are rigidly mounted on a shaft 40 which is journalled to a support member 41 which is in turn rigidly mounted on the frame 31.

In this particular embodiment, it is the thrust of the worm 38 that moves the developing unit toward and away from the belt 1. While this embodiment is similar to the previous embodiment as to the function, it allows the output speed of the motor to be reduced with ease and, therefore, eliminates the need for a speed reduction arrangement associated with an ordinary developing unit.

When the frame 31 shown in FIG. 6 is bodily pulled upward away from the apparatus body, the idle gear 36 shown in FIG. 7 will be released from the motor gear 35. When the developing unit is removed from the frame 31 having been dismounted from the apparatus body, the worm gear 39 shown in FIG. 7 will be released from the worm 38.

In summary, it will be seen that the present invention provides an image forming apparatus which allows each developing unit to be moved between a developing and a non-developing position easily and surely with a simple construction which does not include any exclusive driving means.

Various modifications will become possible for those skilled in the art after receiving the teachings of the present disclosure without departing from the scope thereof.

What is claimed is:

1. An image forming apparatus comprising:

an image carrier for forming an electrostatic latent image thereon;

a plurality of developing units each being located to face said image carrier;

a developing roller incorporated in each of said plurality of developing units for developing the latent image;

support means for supporting said developing units such that said developing units are movable between a developing position for effecting development and a nondeveloping position for not effecting development and positioning means for positioning the developing units at the developing position and the nondeveloping position;

driving means for generating a driving force; and driving force transmitting means for transmitting said driving force to each of said developing units;

said driving force transmitting means including first gear means mounted on the developing roller of at least one of said developing units and second gear means driven by said driving means, said second gear means being engaged with said first gear means wherein the first and second gear means are operatively connected to each other such that when the second gear means is driven, the first and second gear means exert a force on the developing unit in a direction in which the developing unit is moved by the support means for moving the selected developing unit along the support means to the positioning means located at the developing position to thereby position the developing unit, and then driving the developing roller.

2. An apparatus as claimed in claim 1, wherein said driving means comprises a motor securely mounted on a body of said apparatus, and said driving force transmitting means comprises a transmission mechanism for transmitting rotation of said motor to said developing rollers.

3. An image forming apparatus, comprising:

an image carrier for forming an electrostatic latent image thereon;

a plurality of developing units each being located to face said image carrier;

a developing roller incorporated in each of said plurality of developing units for developing the latent image;

support means for supporting said developing units such that said developing units are movable between a developing position for effecting development and a nondeveloping position for not effecting development;

single driving means for generating a driving force; and driving force transmitting means for transmitting said driving force to each of said developing units;

said driving force transmitting means including means for moving any one of said developing units selected from the nondeveloping position to the developing position via said support means and rotating the developing roller associated with said selected developing unit wherein said single driving means comprises a motor securely mounted on a body of said apparatus, and said driving force transmitting means comprises a transmission mechanism for transmitting rotation of said motor to said developing rollers wherein said motor comprises a variable speed motor which is rotatable at a low speed while any of said developing units is moved toward the developing position, at a high speed while development is under way, and at a low speed while said developing unit is moved toward the nondeveloping position.

* * * * *